US007284292B2

(12) United States Patent
Jaffe

(10) Patent No.: US 7,284,292 B2
(45) Date of Patent: Oct. 23, 2007

(54) SCRUB BRUSH IMPLEMENT

(75) Inventor: Jonathan A. Jaffe, Voorhees, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 327 days.

(21) Appl. No.: 11/111,231

(22) Filed: Apr. 21, 2005

(65) Prior Publication Data

US 2006/0236473 A1 Oct. 26, 2006

(51) Int. Cl.
*A46B 13/02* (2006.01)

(52) U.S. Cl. ..... 15/28; 15/22.1

(58) Field of Classification Search ..... 15/22.1, 15/28, 23

See application file for complete search history.

(56) References Cited

U.S. PATENT DOCUMENTS 3,407,431 A * 10/1968 Melnik ..... 15/344
4,158,246 A * 6/1979 Meadows et al. ..... 15/28
4,299,004 A * 11/1981 Lancaster ..... 15/97.1
4,724,563 A * 2/1988 Fry et al. ..... 15/28
4,885,815 A * 12/1989 Smith ..... 15/28
5,423,102 A * 6/1995 Madison ..... 15/22.2
5,636,400 A * 6/1997 Young ..... 15/23
5,881,418 A * 3/1999 Enoch ..... 15/101
2004/0255410 A1* 12/2004 Schonewille et al. ..... 15/29
2005/0278879 A1* 12/2005 Schnabel et al. ..... 15/97.1

* cited by examiner

*Primary Examiner*—Randall Chin
(74) *Attorney, Agent, or Firm*—Stuart M. Goldstein

(57) ABSTRACT

A manually operated scrub brush implement uses batteries to drive a motor, through gearing to rotate a first scrub brush mounted on the implement for rotational brush cleaning of soiled surfaces. A second, stationary scrub brush, mounted at an angle in relation to the first scrub brush, is positioned on the lower surface of the implement to allow the user the option to use the scrub brush implement as a manual scrub brush as well, by applying pressure on the handle section of the implement to clean ingrained soiled surfaces.

6 Claims, 2 Drawing Sheets

SCRUB BRUSH IMPLEMENT

BACKGROUND OF THE INVENTION

The use of brushes for scrubbing, brushing, polishing, and general overall cleaning of soiled surfaces is well-known. Manual scrub brushes have been and continue to be popular as highly effective cleaning tools which are simple and basic in concept and generally inexpensive to manufacture. However, in order to assist in the cleaning process and alleviate the strenuous back and forth labor involved with manual scrubbing, handheld motor driven scrubbers have been developed. Such scrubbers often contain sealed, waterproof housings and electric motors which rotate or oscillate cleaning elements to be used on soiled surfaces.

Although powered scrubbers help to relieve some of the rigorous labor required in the cleaning process, there are clearly occasions during cleaning operations in which the application of pressure to remove stubborn ingrained dirt requires the use of the basic, manual brush.

Nevertheless, while there are numerous manual type scrub brushes and many powered scrubbers, there has yet been developed a scrub brush implement which advantageously combines manual and powered cleaning elements in a single, simple, lightweight cleaning implement.

SUMMARY OF THE INVENTION

It is thus an object of the present invention to provide a scrub brush implement which overcomes the disadvantages, shortcomings, and limitations of existing cleaning implements.

It is an object of the present invention to provide a scrub brush implement which provides the advantages of both manual scrub brushes and powered scrub brushes.

It is another object of the present invention to provide a scrub brush implement which effectively and efficiently unites a manual scrub brush with a powered scrub brush as a lightweight, portable, easy to use cleaning implement.

It is a further of the present invention to provide a scrub brush implement which has an electric motor powered rotary cleaning head and a manual, stationary scrub brush to allow the user the option of alternate cleaning surfaces.

These and other objects are accomplished by the present invention, a manually operated scrub brush implement which uses batteries to drive a motor, through gearing to rotate a first scrub brush mounted on the implement for rotational brush cleaning of soiled surfaces. A second, stationary scrub brush, mounted at an angle in relation to the first scrub brush, is positioned on the lower surface of the implement to allow the user the option to use the scrub brush implement as a manual scrub brush as well, by applying pressure on the handle section of the implement to clean ingrained soiled surfaces.

Novel features which are considered as characteristic of the invention are set forth in particular in the appended claims. The invention itself, however, both as to its design, construction and use, together with the additional features and advantages thereof, are best understood upon review of the following detailed description with reference to the accompanying drawings.

DETAILED DESCRIPTION OF THE DRAWINGS

Figure 1:
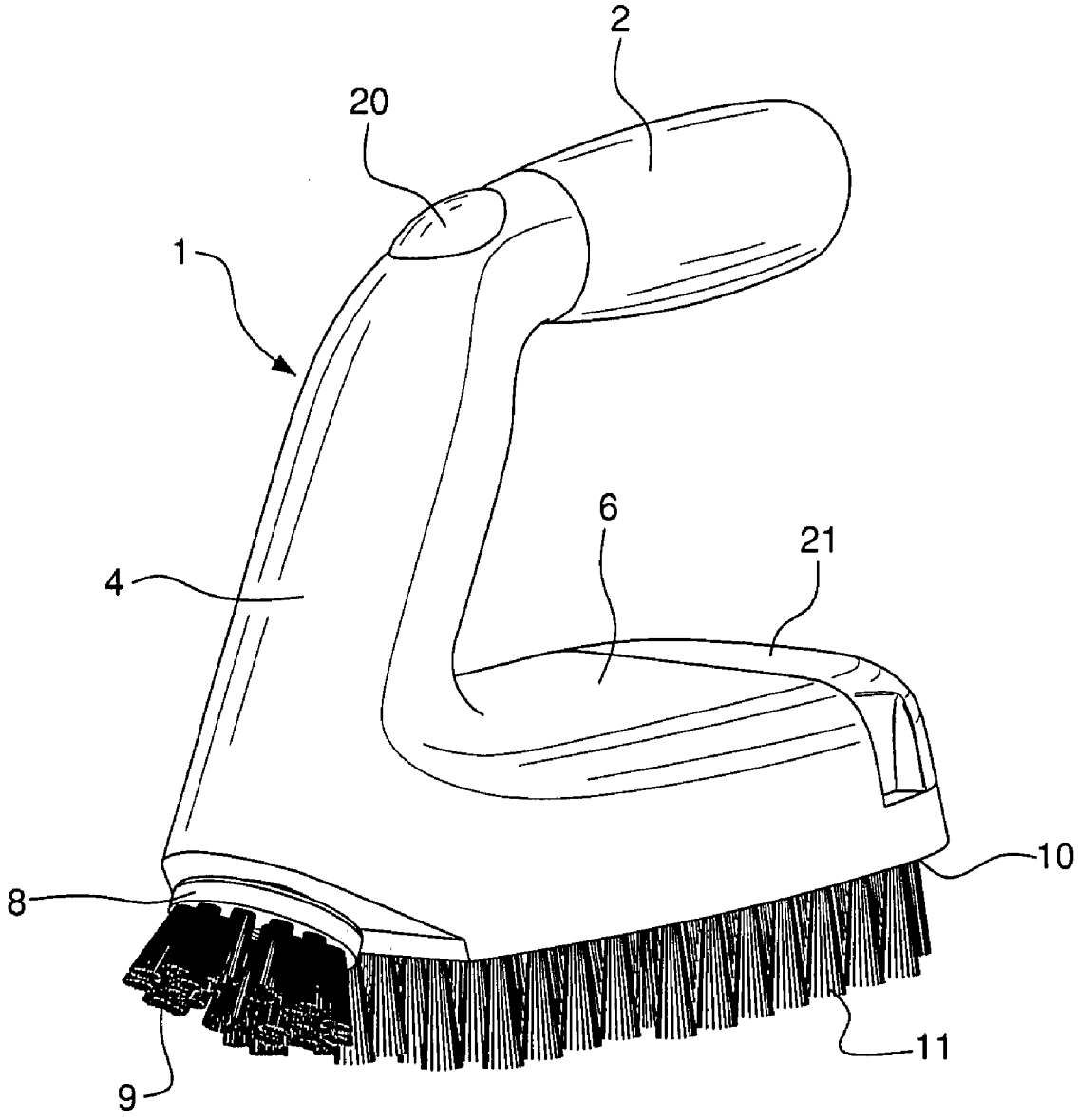
FIG. 1 is an isometric view of the scrub brush implement of the present invention.
Figure 2:
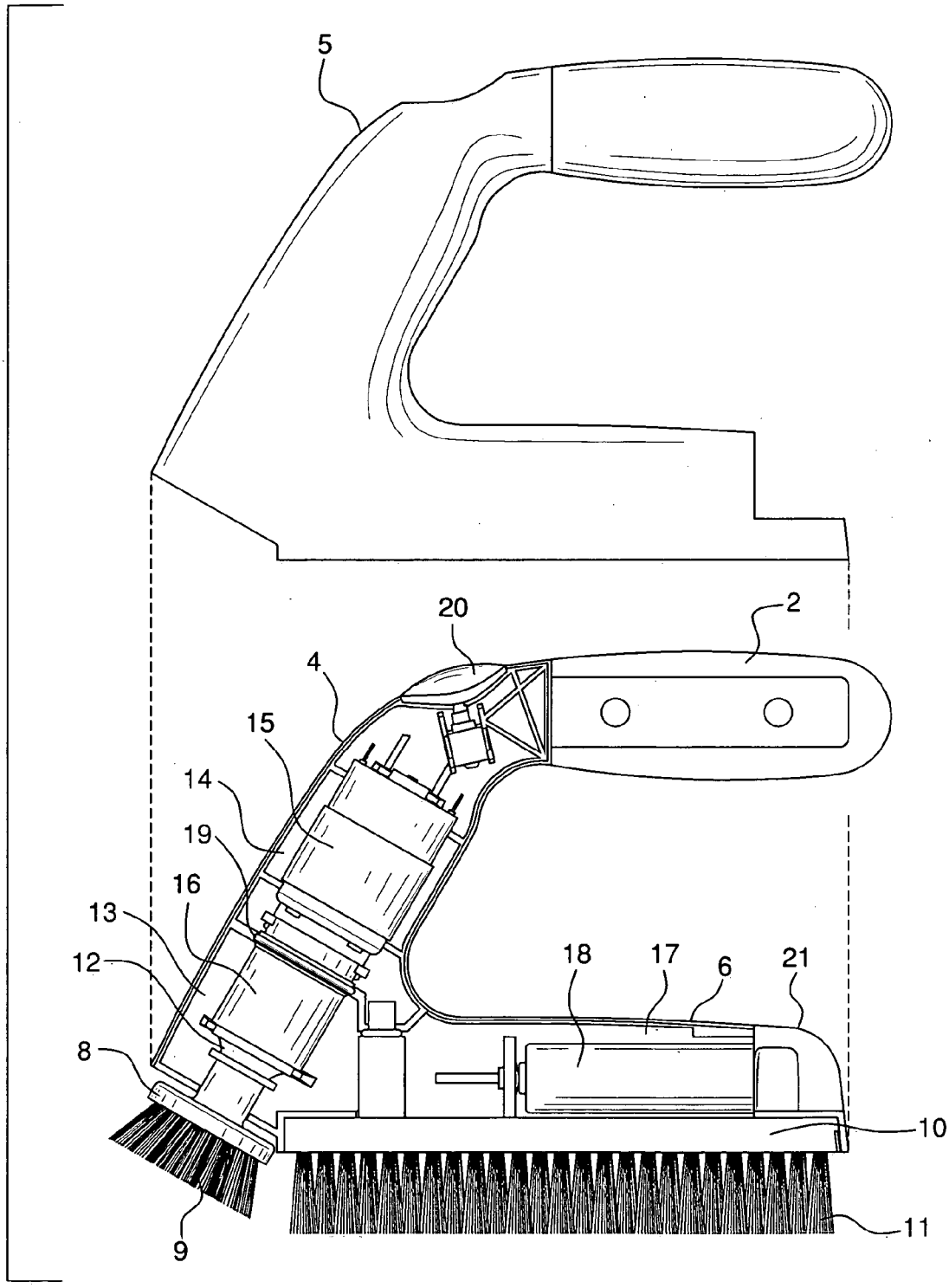
FIG. 2 is a cross-sectional view of the scrub brush implement of the present invention.

Manually operated, handled scrub brush implement 1 of the present invention comprises a unitary body with handle section 2 and contiguous intermediate section 4 and lower section 6. Intermediate section 4 is positioned at an angle in relation to lower section 6. The unitary body of scrub brush implement 1 is substantially encased by housing 5 which sealingly encloses compartment space 14 in intermediate section 4 and compartment space 17 in lower section 6. It is contemplated that housing 5 will be manufactured of lightweight plastic and be formed as a single casing to enclose the internal components of scrub brush implement 1. Housing 5 could also be formed in two halves which are attached to sealingly enclose the components of scrub brush element 1.

Space 14 in intermediate section 4 and space 17 in lower section 6 are watertight compartments, sealed with static o-ring 19. This protects the components located within spaces 14 and 17 from the entry of fluid. Space 13 in intermediate section 4 is not watertight, but rotary lip seal 12 provides waterproof protection to planetary gearing 16, located within the space.

Positioned within space 14 of intermediate section 4 is electric motor 15 which drives planetary gearing 16, located in space 13. One or more batteries 18 are located in space 17 of lower section 6. A replaceable or rechargeable battery or batteries 18 provide the source of electrical power, through electrical wiring (not shown) which extends through intermediate section 4, to activate switch 20 located near handle section 2. Electric power could also be provided by a plug-in electrical adapter. Switch 20 can be click-on/click-off, or a momentary type switch.

Brush head 8 with bristles 9 extend down from intermediate section 4 of housing 5. Brush head 8 is operably attached to planetary gearing 16 for rotational movement.

Brush head 10 comprises bristles 11 and is mounted, in stationary fashion, to lower section 6 of housing 5. Brush head 10 extends from the bottom surface of lower section 6. Brush heads 8 and 10 are mounted at an angle in relation to each other.

When powered scrubbing is desired, switch 20 is activated, thus allowing electrical power from battery or batteries 18 to run motor 15, which in turn operates planetary gearing 16 to rotate brush head 8. Rotating bristles 9 of head 8 are now available to clean soiled surfaces. When circumstances call for the use of a manual brush, switch 20 can be turned off, thus stopping rotation of brush head 8. Manual pressure on handle section 2 permits use of scrub brush implement 1 as a manual scrub brush, employing stationary brush head 10 and its bristles 11 to clean soiled surfaces.

By this scrub brush implement, both manual and power scrubbing can be accomplished with a single cleaning tool. With this versatility, and given the compact, lightweight, self-contained nature of scrub brush implement 1, a variety of soiled surfaces in many varied environments can be cleaned. The positioning of brush heads 8 and 10 of brush implement 1 also permits the user to readily and comfortably shift between the two brush heads, when circumstances dictate specific usage. Battery or batteries 18 can be simply and easily replaced by removing end cap 21 from lower section 6, removing the old battery or batteries, and installing fresh ones or recharging the ones being used.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A manually operated, handheld brush implement comprising:

a unitary body having an upper handle section to be gripped by a user, said handle section being cantilevered out from an elongated intermediate section contiguous with and angled downward from the handle section, said intermediate section being the sole connection between the cantilevered handle and a lower section contiguous with the intermediate section, said body having outer housing means enclosing a space with two separate compartments within the intermediate section and a second space within the lower section;

a source of electricity located within the second space;

drive means powered by the source of electricity for operating gear means, said drive means being located in one of the compartments within the space of the intermediate section and gear means being located in the second compartment within the space of the intermediate section, both the drive means and the gear means being positioned at an obtuse angle in relation to the handle;

switch means for activating the drive means;

first brush means comprising scrubbing bristles for rotatably scrubbing soiled surfaces, said brush means extending from the intermediate section, whereby upon activation of the drive means by the switch means, the gear means rotatably operates the brush means; and second brush means comprising a brush head and scrubbing bristles for cleaning soiled surfaces upon application of pressure on the handle section, said second brush means being below the second space and extending from the lower section and being immovably fixed in relation to said lower section.

2. The brush implement as in claim 1 wherein the intermediate and lower sections are positioned at an angle in relation to each other.

3. The brush implement as in claim 1 wherein the first and second brush means are positioned at an angle in relation to each other.

4. The brush implement as in claim 1 wherein the gear means comprises planetary gearing.

5. The brush implement as in claim 1 wherein the lower section is water tight.

6. The brush implement as in claim 1 wherein the source of electricity comprises at least one battery.

* * * * *